United States Patent [19]

McKay

[11] Patent Number: 4,925,026

[45] Date of Patent: May 15, 1990

[54] TOOL HOLDER INSERT FOR A BUCKET

[76] Inventor: Richard S. McKay, 1781 Sumner Rd., Coos Bay, Oreg. 97420

[21] Appl. No.: 364,113

[22] Filed: Jun. 12, 1989

[51] Int. Cl.[5] ..... B65D 85/20

[52] U.S. Cl. ..... 206/373; 206/372; 211/70.6; 220/85 D; 312/249

[58] Field of Search ..... 206/373, 374, 372; 211/70.6; 220/85 R, 85 D, 85 H; 312/107, 249

[56] References Cited

U.S. PATENT DOCUMENTS

| | | | |
|---|---|---|---|
| 1,249,439 | 12/1917 | McCoy | 206/373 |
| 1,633,030 | 6/1927 | Lawrence | 206/373 |
| 1,914,276 | 6/1933 | Moore | 206/373 |
| 2,893,806 | 7/1959 | Joseph | 312/249 |
| 4,286,717 | 9/1981 | Liesinger | 211/70.6 |
| 4,362,243 | 12/1982 | Deyesso et al. | 206/373 |
| 4,765,472 | 8/1988 | Dent | 206/373 |
| 4,826,007 | 5/1989 | Skele | 206/373 |

*Primary Examiner*—Paul T. Sewell
*Assistant Examiner*—Jacob K. Ackun, Jr.
*Attorney, Agent, or Firm*—James D. Givnan, Jr.

[57] ABSTRACT

A container is provided with an insert having an inner surface to which are affixed spiral springs which frictionally engage and hold tools inserted therebetween. A cabinet is slidably mounted on the wall component to carry an assortment of small items in cabinet drawers. The cabinet and an interchangeable holder component are removably attached to the insert wall component by spaced apart guides. A tray is positionable in the bottom of the container.

8 Claims, 1 Drawing Sheet

TOOL HOLDER INSERT FOR A BUCKET

BACKGROUND OF THE INVENTION

The present invention pertains generally to portable containers for a workman's tools.

The performance of work in the field by mechanics, electricians and others often necessitates the carrying of a number of tools and parts. Conventional hand carried tool boxes do not separate the tools from one another nor do they provide a number of closed storage areas for small parts. Accordingly a considerable amount of time may be lost on a job by reason of the tradesman having to make repeated trips to his vehicle for tools and parts. Further time may be spent in sorting through a tool box for a sought after tool or part. Lastly, a tool box of standard configuration does not provide a sitting surface for use by the worker during performance of the job at hand.

U.S. Pat. No. 4,362,243 shows circular inserts or rings for placement in a bucket which are shaped for tool reception. U.S. Pat. No. 1,249,439 discloses a tool box of circular shape with vertical leaf springs for tool engagement. U.S. Pat. No. 4,765,472 shows an apron with tool receiving pockets for external suspension about a bucket.

SUMMARY OF THE PRESENT INVENTION

The present invention is embodied in a container mounted tool holder insert having yieldable means extending about an internal surface of the insert to hold tools in place.

The insert is of conical shape and sized so as to rest in surfacial engagement with the interior of the container. If desired, a subjacent tray may be used for the storage of various items. Yieldable means in the form of spiral springs are held in place on an insert wall surface by brackets which retain the springs against the wall and/or against a tool urging same into forceful frictional contact with the wall. Accordingly the tools are isolated from one another to facilitate identification, selection and return. Additionally loop shaped holders on the insert may be used to carry a tool in a suspended manner. The central area of the container may be used for the transport of large parts or tools and supplies.

A cabinet of the insert is particularly useful when an array of small parts is needed by the workman. The cabinet may be replaced by a flashlight holder which positions flashlights in a readily accessible manner. A lid for the container permits the container to be used as a stool for use at the work site.

Important objectives include the provision of an insert for use within a circular container to permit the orderly transport of a wide array of tool shapes and sizes as well as a quantity of parts useable at the job site; the provision of an insert for a container that serves to hold the tools adjacent one another and upright against the container side for easy access and replacement; the provision of an insert which may be used in a bucket without modifying the later; the provision of an insert which supports a cabinet permitting removal of same and which may be replaced by a second component such as a flashlight holder; the provision of an insert which is attachable to a container in a manner having room below the insert proper for a removable tray.

DETAILED DESCRIPTION OF THE PREFERRED EMBODIMENTS

Figures 1, 2, 3, 4, 5, 6:
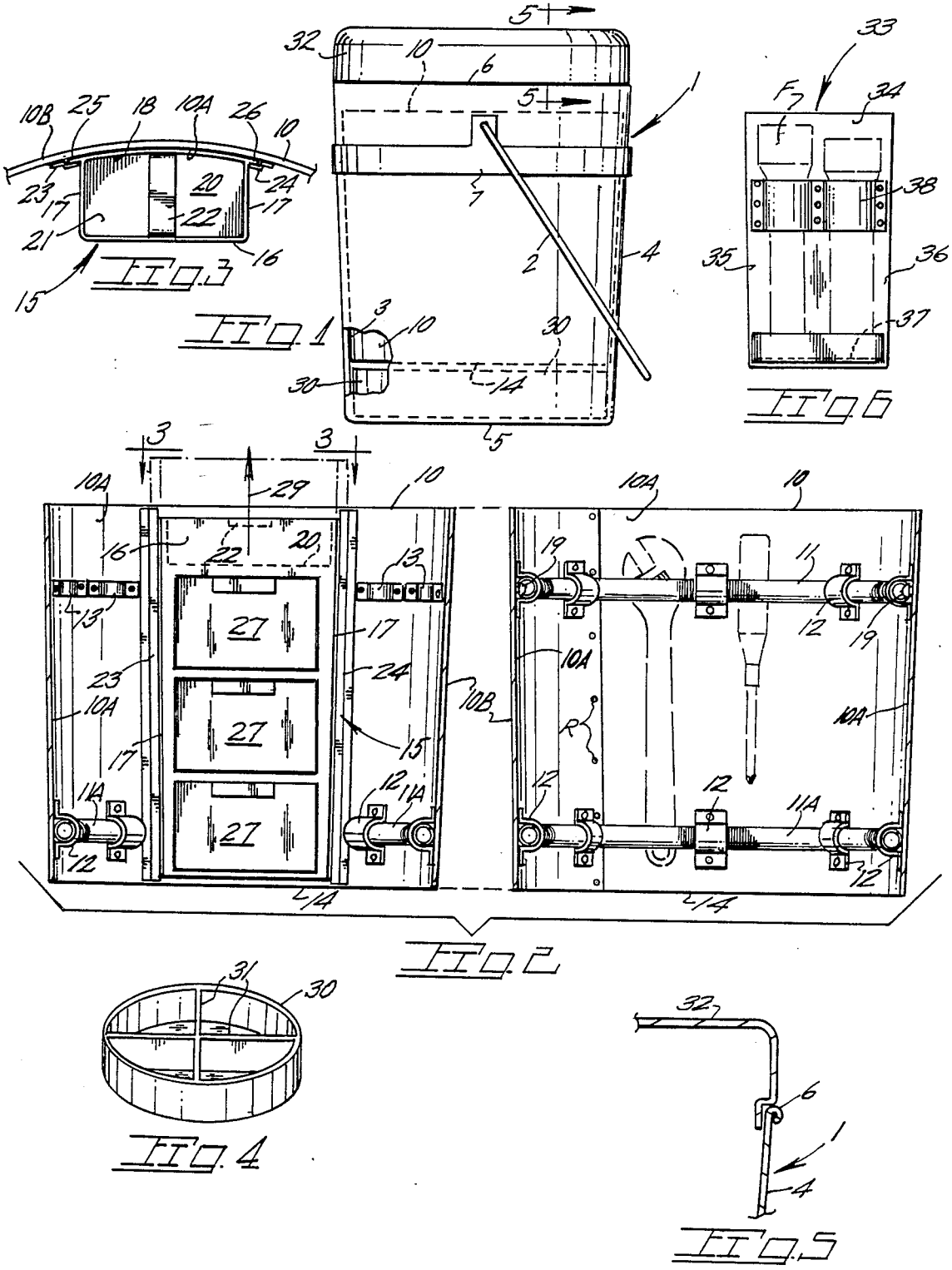
FIG. 1 is a front elevational view of the container in which the present insert is carried.
FIG. 2 is a vertical sectional view of the insert separated along a vertical medial plane and each half rotated through ninety degrees.
FIG. 3 is a plan view of the cabinet taken downwardly along line 3—3 of FIG. 2.
FIG. 4 is a downward perspective view of the insert tray.
FIG. 5 is a vertical sectional view taken along line 5—5 of FIG. 1.
FIG. 6 is an elevational view of a holder for installation into guides in place on the insert walls.

With continuing attention to the drawings, the reference numeral 1 indicates generally a circular container such as a bucket with a bail type handle 2. Inner and outer container wall surfaces are at 3 and 4 while a bottom wall is indicated at 5. A rim is at 6. A stiffener 7 serves to receive the turned ends of handle 2. The unseen side of the container would be a mirror image of FIG. 1.

An insert wall component at 10 has inner and outer wall surfaces at 10A and 10B. The component is assembled into frustoconical shape such as by rivets R and sized to surfacially engage inner wall 3 of the container.

Tool retainer means includes a spiral spring 11 held in place against insert inner wall surface 10A by U-shaped brackets 12 suitably secured as by rivets to the insert. Looped ends of spring 11 are secured to wall component 10 by screws 19. Tool insertion between spiral spring 11 and the adjacent insert surface 10A requires a slight degree of manual effort resulting in positive tool retention by the spring and surface. A second spring 11A, similarly secured, is preferably included for tool retention depending on tool size. For small tools, loops at 13 are provided suitably secured to inner surface 10A of the insert wall component. A lower edge of the insert wall component is at 14.

Held in place on the wall component of the insert is a cabinet generally at 15 having a front wall 16, side walls 17 and a back wall 18. A top wall 20 is recessed to provide a receptacle 21 for small parts. A cabinet handle at 22 extends between the cabinet front and back walls to facilitate lifting of the cabinet away from the insert wall component per arrow 29. The cabinet is slidably carried by the wall component by means of guides at 23–24 which are of Z shape in section to receive side flanges 25–26 on the cabinet sides on the back wall thereof. Cabinet drawers are at 27.

A tray at 30 is circular for placement in the bottom of container 1 and is of a height to permit seating of insert wall component 10 against wall surface 3 of the container. Tray partitions are at 31.

Preferably container 1 includes a cover at 32 which may serve both as a seat as well as a cover to protect the tools from the weather.

A holder generally at 33 includes a back wall 34 having upright margins at 35–36 in the nature of flanges which slidably engage guides 23–24 when cabinet 15 is removed. In some forms of the invention, it may be desirable to shorten spring length to provide adequate surface area on inner wall surface 10A of wall 10 to permit the installation of pairs of guides 23–24 for simultaneous cabinet and holder mounting. A platform 37 supports a pair of flashlights F or other articles. A strap is at 38 shaped to best suit the articles being held in place on the platform.

While I have shown but a few embodiments of the invention, it will be apparent to those skilled in the art that the invention may be embodied still otherwise without departing from the spirit and scope of the invention.

Having thus described the invention, what is desired to be secured by a Letters Patent is:

I claim:

1. An insert for a container having a circular interior surface and a handle, said insert comprising, a wall component of frustoconical shape for engagement with said interior surface of the container, said wall component including a cabinet, and tool retainer means on said wall component including a horizontal elongate spiral spring, bracket means on said wall component holding said spring against the wall component to bias tools inserted between the spring and the wall component against the latter.

2. The insert claimed in claim 1 wherein said tool retainer means includes an additional horizontal elongate spring and bracket means on said wall component vertically offset from the first mentioned spring and bracket means to confine the lower portion of large tools.

3. The insert claimed in claim 1 wherein said bracket means are spaced apart U-shaped brackets.

4. The insert claimed in claim 1 wherein said cabinet is detachably mounted on the wall component.

5. The insert claimed in claim 4 wherein the wall component includes guides, said cabinet including flanges for removable sliding engagement with said guides.

6. The insert claimed in claim 1 including a tray for placement in the container below said tool retainer means.

7. The insert claimed in claim 1 wherein said wall component includes guides spaced from one another, a flashlight holder having flanges for sliding engagement one each with said guides.

8. A tool holder insert for a bucket comprising, a continuous wall component for surfacial engagement with the bucket interior, first and second spiral springs attached to and horizontally disposed along the wall component in a vertically spaced manner, U-shaped brackets at spaced apart locations along the first and second spiral springs, said brackets secured to the wall component to confine the springs in place against said wall component so as to cause same to frictionally engage and hold tools in place inserted between one or both of said springs and the wall component.

* * * * *